US006519871B2

(12) United States Patent
Gardner et al.

(10) Patent No.: US 6,519,871 B2
(45) Date of Patent: Feb. 18, 2003

(54) SELF PROGRAMMING CLOTHES DRYER SYSTEM

(75) Inventors: Douglas W. Gardner, Newton, IA (US); Michael D. Lafrenz, Newton, IA (US); Kim L. Wright, Newton, IA (US)

(73) Assignee: Maytag Corporation, Newton, IA (US)

( * ) Notice: Subject to any disclaimer, the term of this patent is extended or adjusted under 35 U.S.C. 154(b) by 64 days.

(21) Appl. No.: 09/864,362

(22) Filed: May 25, 2001

(65) Prior Publication Data

US 2002/0184789 A1 Dec. 12, 2002

(51) Int. Cl.[7] ..... F26B 3/00

(52) U.S. Cl. ..... 34/497; 34/491; 34/495; 34/527; 34/575; 34/606

(58) Field of Search ..... 34/491, 497, 493, 34/495, 527, 543, 550, 575, 600

(56) References Cited

U.S. PATENT DOCUMENTS

| | | | |
|---|---|---|---|
| 3,508,340 | A | 4/1970 | Kombol |
| 3,702,030 | A | 11/1972 | Janke |
| 3,733,712 | A | 5/1973 | Smith |
| 3,762,064 | A | 10/1973 | Offutt |
| 4,385,452 | A | 5/1983 | Deschaaf |
| 4,422,247 | A | 12/1983 | Deschaaf |
| 4,477,982 | A | 10/1984 | Cotton |
| 4,531,305 | A | 7/1985 | Nagayasu et al. |
| 4,640,022 | A | 2/1987 | Suzuki et al. |
| 4,738,034 | A | 4/1988 | Muramatsu et al. |
| 4,763,493 | A | 8/1988 | Nishite et al. |
| 5,161,314 | A | 11/1992 | Souza |
| 5,193,292 | A | 3/1993 | Hart et al. |
| 5,291,667 | A | 3/1994 | Joslin et al. |
| 5,315,765 | A | 5/1994 | Holst et al. |
| 5,321,897 | A | 6/1994 | Holst et al. |
| 5,345,694 | A | 9/1994 | Hayashi |
| 5,444,924 | A | 8/1995 | Joslin et al. |
| 5,454,171 | A | 10/1995 | Ikeda et al. |
| 5,560,124 | A | 10/1996 | Hart et al. |
| 5,619,614 | A | 4/1997 | Payne et al. |
| 5,682,684 | A | 11/1997 | Wentzlaff et al. |
| 6,047,486 | A | 4/2000 | Reck et al. |
| 6,122,840 | A | 9/2000 | Chbat et al. |
| 6,373,032 | B1 * | 4/2002 | Bruntz et al. ..... 219/494 |

FOREIGN PATENT DOCUMENTS

| | | |
|---|---|---|
| DE | 3703671 | 8/1988 |
| DE | 4121015 | 1/1993 |
| JP | 60-25153 | 6/1985 |
| JP | 1-236099 | 9/1989 |
| JP | 4-97793 | 3/1992 |

* cited by examiner

*Primary Examiner*—Pamela Wilson
(74) *Attorney, Agent, or Firm*—Diederiks & Whitelaw, PLC

(57) ABSTRACT

A method and apparatus for operating an automatic cycle of a clothes dryer wherein after initiation of an automatic cycle, a CPU displays the expected time remaining during the current cycle. At various times during the cycle, the expected time remaining is updated by comparing the time required to reach certain moisture levels of the articles contained therein to reference times. The comparison also results in the expected times being updated for future uses of the clothes dryer. Finally, the invention includes a system for updating the amount of time required to reach a desired final temperature during a cooldown sequence.

26 Claims, 4 Drawing Sheets

SELF PROGRAMMING CLOTHES DRYER SYSTEM

BACKGROUND OF THE INVENTION

1. Field of the Invention

The present invention relates to a control system for a clothes dryer. In particular, a moisture sensor is provided to terminate a drying process when the amount of moisture present in the clothes inside the dryer reaches a desired level as selected by a user. Additionally, the clothes dryer of this invention includes a drying schedule which estimates the amount of drying time left in the current cycle, by taking into account differences between an initial estimation and the final result each time the dryer has been run. The length of a cooldown sequence is also updated.

2. Discussion of the Prior Art

It is well known in the art to provide a clothes dryer with a simple time-dry control, in addition to a sensor-dry mode. When the time-dry control is used, the user places the wet articles inside the dryer and selects a duration for the drying process. Because there is little or no automatic control or adjustment during the process, the drying process simply continues until the time expires. The result can be inefficient, because it is difficult for a user to accurately estimate the time required to reach a desired, final moisture level prior to operating the machine.

In comparison, sensor-dry modes are provided to automatically control a drying operation. Specifically, when a sensor-dry mode is selected, the user places wet articles inside the dryer drum and selects a final dryness level. Instead of forcing the user to guess how long the process should take, the machine stops when the desired dryness level is reached. For this purpose, the machine includes at least one sensor for detecting the level of moisture of the articles. The machine simply operates until the moisture sensor detects the final desired dryness level selected by the user. By terminating the process upon achieving the desired final dryness level, there is no need to re-start the process to finish incomplete drying. In addition, extra energy is not expended to dry the articles beyond the desired dryness level.

Electronic controls have been developed to assist in the operation of such an automatic drying processes. For example, U.S. Pat. No. 3,762,064, to Offut, discloses a system for automatic operation of a dryer in which extra time is added to a drying process according to a predetermined table. A selection of a dryness level beyond a predetermined level (e.g. damp-dry) results in the addition of extra time. The duration of this extra time is dependent upon the length of time required to reach the predetermined dryness level and the desired final dryness level selected by the user. While this system incorporates a moisture sensor for making a drying operation more efficient, this system is nevertheless highly inefficient, because only one threshold dryness level is detected and the final dryness level is never actually measured, as the time to reach that level is only estimated. Therefore, just as in time dry modes, the articles will often be either under-dried and still wet, or over-dried. Even if the system were able to accurately estimate the time required to be added to a single cycle to reach a desired dryness level, the estimation would need to be performed each time the clothes dryer is run. Therefore, the system does not allow the circuitry to "learn" about how the clothes dryer is being run to more efficiently operate and give more accurate time readings for completion of a drying cycle.

U.S. Pat. No. 4,477,892, to Cotton, represents an improvement over the system disclosed in the '064 patent, and includes sensors or electrodes which contact the wet articles to determine the current moisture level contained therein. Through the system of this patent, the current moisture level inside the machine can be measured at a variety of continuous levels. By comparing the number of conductive electrode "hits" during a given time period, it is possible to estimate the current degree of dryness. In any event, when a sense dry mode is selected in a conventional clothes dryer, the user is given little, if any, indication that the cycle is coming to an end.

It is also common to utilize a cooldown sequence or procedure at the conclusion of a drying cycle. During this cooldown procedure, cool or non-heated air is passed through the drum of the clothes dryer for a predetermined period of time to more slowly bring articles of clothing down to room temperature and help prevent creasing therein. In the majority of clothes dryers with a cooldown procedure, the cooldown time is either determined by the user or is preset as a static and unchangeable period of time.

As a result, cooldown sequences can be as inefficient as certain drying operations. First, for a user to correctly estimate the amount of time required for a cooldown cycle, he must take into account, (1) temperature of the drying cycle, (2) clothes load, (3) clothes type, and (4) temperature of the cool air being introduced. Hence, accurate estimations are nearly impossible, and the load is often not cooled sufficiently, or is "over-cooled". Even when a preset cooldown duration is utilized, the result is usually the same. Because individuals use their machines differently, i.e. with different typical clothes loads, different typical clothes type mixtures, and have varying cool air inlet temperatures, any preset cooldown duration will, in all likelihood, be inaccurate.

Therefore, there exists the need in the art to provide a control system for a clothes dryer which allows for an adjustable duration setting for both a sensor dry estimation and a cooldown sequence for subsequent uses.

SUMMARY OF THE INVENTION

The present invention is particularly directed to a control system for a clothes dryer including a timer and a sensor which measures a drying parameter to calculate how long, with respect to a predetermined time, the clothes dryer needs to be operated to reach a particular condition and to update the predetermined time for subsequent uses. Additionally, a display is included to show the user the amount of time remaining in the current drying cycle, according to the predetermined time.

In a first embodiment, a moisture sensor is included to measure a current moisture level of articles contained within the clothes dryer. Prior to initiating a drying cycle, the user selects a drying temperature and a dryness level. Through a CPU, the control system determines and displays an expected drying cycle time. At certain times in the drying process, the control system checks the actual duration against the expected duration and updates the time remaining displayed. In addition, the expected duration for subsequent cycles is altered. Specifically, during the first few, preferably ten, runs of the clothes dryer, one-half of the difference between the actual run time and the expected run time is respectively added or subtracted from the expected run time value. And, after each later operation, i.e., operations following the first ten, the expected run time is altered by one-quarter of the difference.

By calculating the expected run time, the expected remaining duration can be advantageously displayed to the user. Accordingly, each time the clothes dryer is run, the time required to reach the selected dryness condition is used to update the existing expected time, to more accurately estimate the time remaining. In this manner, average load conditions are "learned" by the clothes dryer.

The "average" load condition is also used to adjust the length of a cooldown sequence at the end of the drying cycle. In the second embodiment, the clothes dryer includes a temperature sensor for measuring the temperature of an exhaust air flow. Specifically, the control system of the invention measures the temperature of the exhaust air flow when the cooldown sequence is complete. If the temperature is equal to or over 100° F. (37.8° C.), the control system adds one minute to the next cooldown sequence. If, however, the temperature of the exhaust air flow is less than 100° F. (37.8° C.), one minute is subtracted from the next cooldown sequence.

Additional objects, features and advantages of the invention will become more readily apparent from the following detailed description of a preferred embodiment thereof, when taken in conjunction with the drawings, wherein like reference numerals refer to corresponding parts in the several views.

DETAILED DESCRIPTION OF THE PREFERRED EMBODIMENTS

Figure 1:
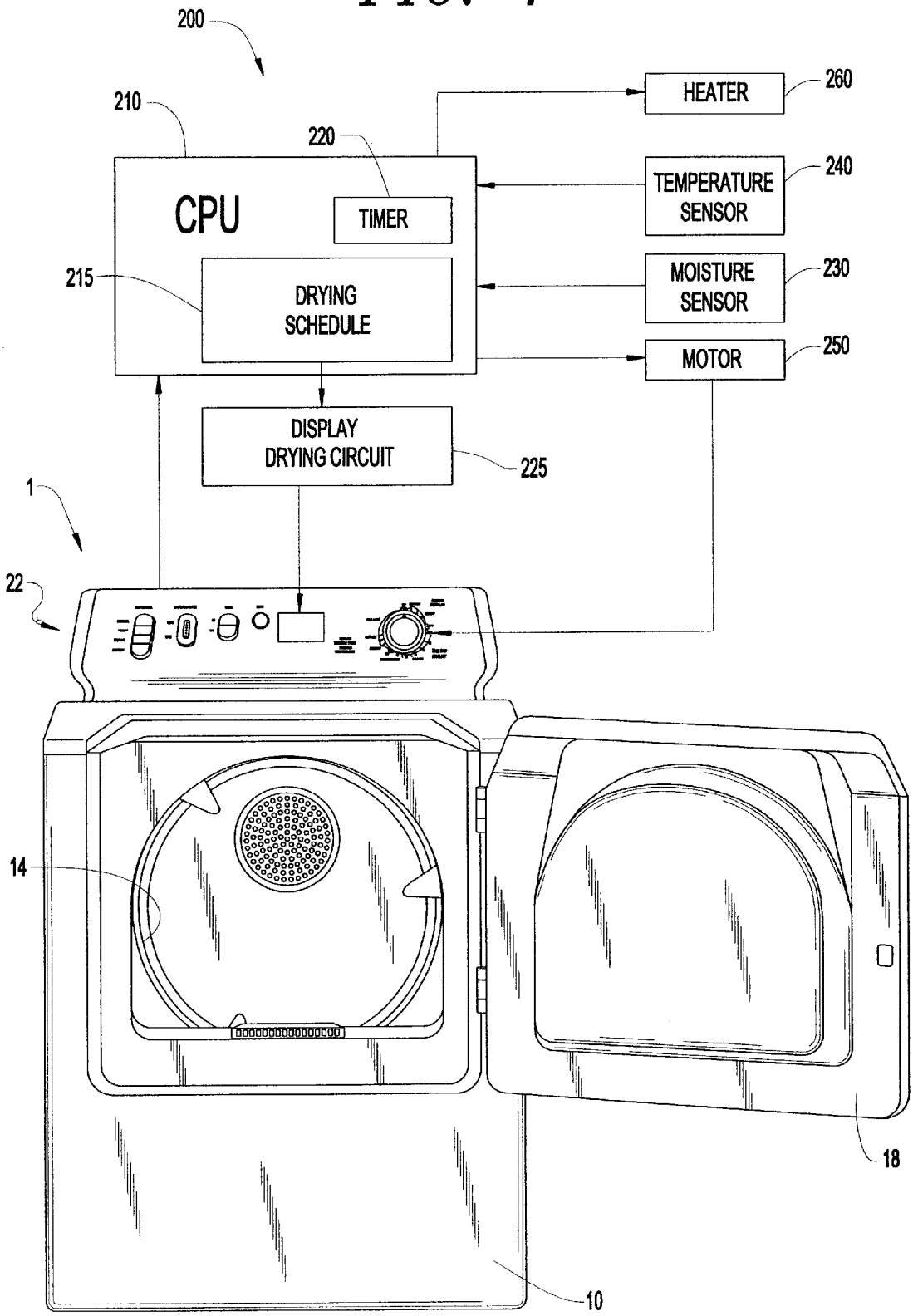
FIG. 1 is a front perspective view of a clothes dryer incorporating a drying schedule according to the invention.

A clothes dryer 1 of the current invention is shown in FIG. 1 and generally includes an outer cabinet 10, having an opening leading to a rotatable drum 14 and a door 18 for closing the opening. Disposed on the upper surface of the outer cabinet is a control panel 22 establishing a desired operational sequence for programming the clothes dryer 1 of the invention.

Figure 2:
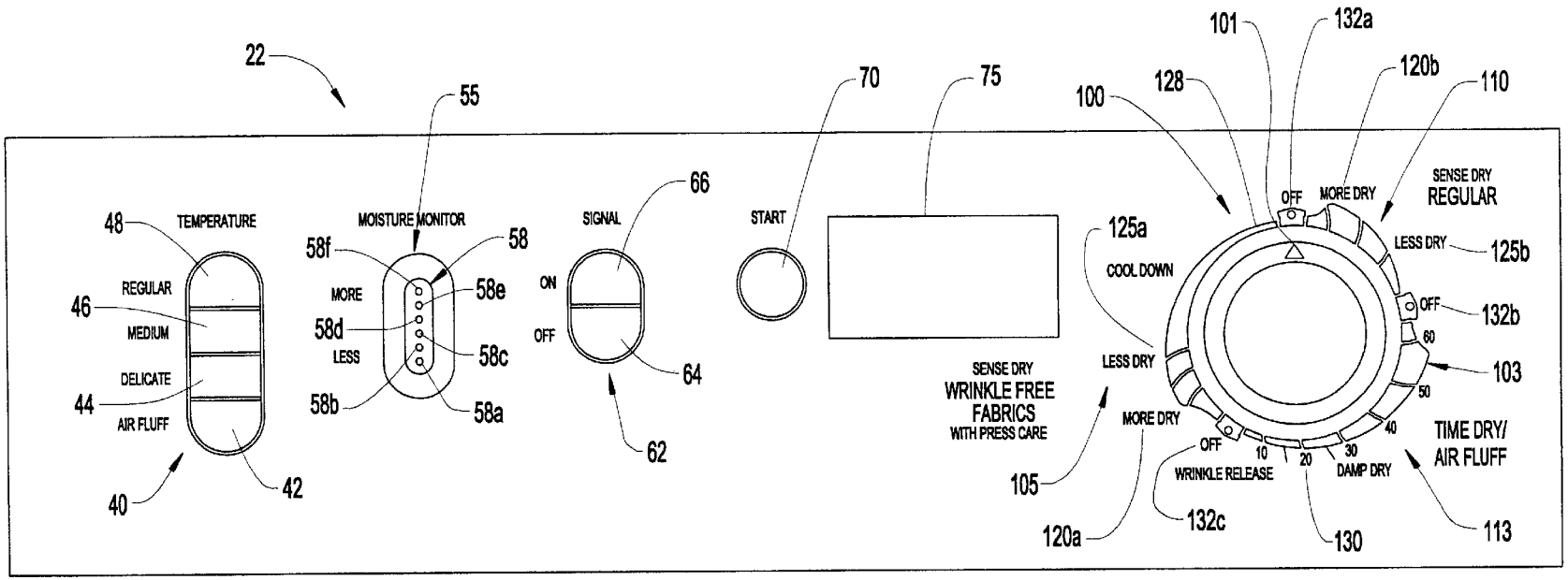
FIG. 2 is a front view of a control panel provided on the clothes dryer of FIG. 1.

FIG. 2 depicts a close-up view of control panel 22 and includes a plurality of buttons and other elements for controlling clothes dryer 1. Although control panel 22 is described below in a specific arrangement, it is understood that the particular arrangement is only exemplary, as a wide range of layouts would suffice. Accordingly, disposed on the left side of control panel 22 is a temperature selector 40, which includes buttons for selecting the heat output of the clothes dryer 1. In the most preferred embodiment, temperature selector 40 includes an air fluff button 42, a delicate button 44, a medium button 46 and a regular button 48.

Next to temperature selector 40 is a moisture monitor 55 for displaying the current moisture state of articles contained within clothes dryer 1. Moisture monitor 55 is shown as including a set of LEDs 58 for indicating the specific moisture level. Because the LEDs 58 are vertically arranged, individual LEDs 58*a–f* can be illuminated to indicate a current moisture level. For example, a low moisture level can be signified by illuminating only LED 58*a*, while a higher moisture level can be shown by illuminating LED 58*d* alone or LEDs 58*a*, 58*b*, 58*c* and 58*d* simultaneously.

Proximate to moisture monitor 55 is a signal controller 62. Signal controller 62 is provided to selectively regulate the operation of a buzzer (not shown), and includes an OFF button 64 and an ON button 66. The selection of ON button 66 causes the buzzer to sound upon completion of the drying operation, while selection of OFF button 62 prevents the buzzer from sounding upon completion of the drying operation. Additionally, control panel 22 includes a start button 70 for commencing operation of clothes dryer 1.

Control panel 22 also includes a display 75 for showing a variety of information to the user. If display 75 is used to only give the user the amount of time remaining in the current cycle by displaying a two-digit number representing a number of minutes, a simple arrangement of two seven-segment LEDs may be utilized to represent the numbers zero through ninety-nine. However, if more information, such as cycle selected, temperature selected, or any of a variety of machine conditions or error messages are to be displayed to the user, a standard LCD panel or LED interface would be more appropriate. In such a case, display 75 can take the form of a 128×96 dot matrix display.

Finally, control panel 22 includes a control dial 100 for programming clothes dryer 1. Disposed on the periphery of the center surface of dial 100 is a location pointer 101 which indicates an established setting for dial 100. Annularly disposed about the periphery of dial 100 is indicia 103 which illustrates the various settings. Specifically, indicia 103 includes a first sense-dry zone 105, a second sense-dry zone 10 and a time-dry zone 113, each defining a portion of indicia 103 and designed to indicate the mode of dryer operation, i.e. a sense-dry mode or a time-dry mode. Sense-dry zones 105 and 110 each include a MORE DRY setting 120*a*, 120*b* and a LESS DRY setting 125*a*, 125*b* with continuous levels therebetween. First sense-dry zone 105 also includes a cooldown setting 128. A plurality of time increments 130 are defined by indicia 103 in time-dry zone 113. Finally, disposed between each of zones 105, 110 and 113 are OFF positions 132. Depending upon the operational state of clothes dryer 1, dial 100, and hence location pointer 101, will reference the appropriate indicia 103.

With reference to FIG. 1, clothes dryer 1 also includes a control circuit generally indicated at 200. Specifically a CPU 210 is provided with a drying schedule 215 stored therein, preferably stored in an internal memory (not shown) of CPU 210, in addition to a timer 220. However, the memory may be external or remote from CPU 210. Connected to both display 75 and CPU 210 is a display driving circuit 225. A moisture sensor 230, also linked to moisture monitor 55, is provided as an additional input to CPU 210, and may be any conventional moisture sensor known in the art, such as the moisture sensor described in U.S. Pat. No. 4,477,982, to Cotton, herein incorporated by reference. A temperature sensor 240 is also connected to CPU 210 for monitoring the temperature of an exhaust air flow during operation of clothes dryer 1. A motor 250 is also included to rotate dial 100. CPU 210 is also used to direct the operation of a heater 260.

After wet articles are placed within drum 14, a user selects an operation in a generally conventional manner. First, temperature selector 42 is used to chose a desired operational temperature for clothes dryer 1. While selection of regular button 48 uses the highest temperature setting and results in the fastest drying time, the "regular" setting may be too hot for some articles. Therefore, additional temperature levels are provided. Before pressing start button 70 and beginning operation of clothes dryer 1, the user rotates dial 100 from OFF setting 132 into time-dry 113, first sense-dry zone 105 or second sense-dry zone 110. If dial 100 is rotated such that location pointer 101 is in a time-dry zone 113, the clothes dryer 1 is in time-dry mode, and simply operates until the time indicated by time increment 130 expires. CPU 210 directs motor 250 to rotate dial 100 at a rate coinciding to time increments 130.

The present invention is particularly directed to the manner in which clothes dryer 1 is used in a sense-dry mode, as indicated by the position of dial 100, wherein clothes dryer 1 continues to run until the dryness level selected by rotating dial 100 is reached. Once start button 70 is pressed, CPU 210 begins operation of clothes dryer 1. After starting rotation of drum 14 and initiating heating, CPU 210 reads the position of dial 100 and, through drying schedule 215, determines an expected drying time. In a preferred embodiment, drying schedule 215 is essentially a table of expected drying times for the various dryness levels and temperature selections but, in another embodiment, drying schedule 215 includes an algorithm into which the temperature selection and selected dryness level are input for determining the expected drying time. In accordance with the invention, prior to the first operation of clothes dryer 1, the following table is preferably loaded into memory as an example of the expected drying times, in minutes, for specified temperatures and dryness levels:

TABLE 1

| | Damp Dry | Less Dry | Normal Dry | More Dry | Very Dry |
|---|---|---|---|---|---|
| Extra Low | 40 | 48 | 58 | 64 | 70 |
| Low | 38 | 44 | 54 | 60 | 66 |
| Medium | 35 | 40 | 52 | 58 | 64 |
| Regular | 32 | 38 | 50 | 56 | 62 |

For example, if medium button 46 and NORMAL DRY are selected, CPU 210 would read thirty-eight minutes as an expected drying time. In order to give the user a visual indication as to the expected finish time, CPU 210 also directs display driving circuit 225 to show the current expected time remaining on display 75. As can be seen from the above table, the times for MORE DRY and VERY DRY are calculated by adding six and twelve minutes respectively to the times found in the NORMAL DRY column. Because display 75 is initiated at the outset of the drying cycle and initially indicates the number read from the table, the reading on display 75 is decremented every minute as directed by timer 220 and display driving circuit 225.

The table of expected drying times is updated every time clothes dryer 1 completes a cycle, both for the current cycle and for subsequent cycles. Because the articles contained within drum 14 of clothes dryer 1 must pass through lower dryness levels on the way to higher dryness levels, the expected drying times are updated as the various dryness levels are passed. For example, if VERY DRY is selected, drying schedule 215 is updated as each of DAMP DRY, LESS DRY, NORMAL DRY and MORE DRY are reached, resulting in five independent updates of drying schedule 215.

Additionally, CPU 210 also updates drying schedule 215 for "dryer" dryness levels when certain dryness levels are selected. In a preferred embodiment, if the user selects DAMP DRY, both the LESS DRY and NORMAL DRY expected drying times are updated as DAMP DRY is reached. However, if the user selects more dry, for example, drying schedule 215 will be updated as the moisture level passes through each of the respective dryness levels.

As a particular dryness level is reached, drying schedule 215 is updated for the selected temperature. The difference between the duration of the current cycle, or cycle time, and the expected drying time (as read from the table of drying schedule 215) is calculated. One-quarter of the calculated difference is respectively added or subtracted to the expected drying time for that dryness level and selected temperature. Because the time differences between the different dryness levels are constant, the entire row, i.e., expected drying times for a temperature selection, is updated. In a preferred embodiment, as exemplified in Table 1, the expected drying times for MORE DRY and VERY DRY are calculated from adding six and twelve minutes respectively to the expected drying time for NORMAL DRY. The remainder of constant differences can be determined by analyzing Table 1. For example, because the difference between the expected times for LESS DRY and NORMAL DRY for the regular temperature selection is twelve minutes, adding any time to the expected time to LESS DRY would result in the same amount being added to NORMAL DRY as well. An example of this procedure is exemplified in FIG. 3, as also described in detail below.

In accordance with the most preferred form of the invention, the first ten times clothes dryer 1 is run a "level set" function is performed and the dryness schedule 215 for each of the temperatures and dryness levels is updated. Specifically, one-half of the calculated difference is respectively added or subtracted to the expected times for medium and regular temperatures and one-quarter of the calculated difference is added or subtracted to the lower two temperature selections. After the first ten cycles, one-quarter of the calculated difference is either added or subtracted, depending on whether the calculated difference is positive or negative, to the expected time for only the selected temperature. In a most preferred embodiment, only the times for the selected dryness level are updated, rather than for each desired dryness level, after the first ten cycles.

Drying schedule 215 also preferably includes a cooldown sequence to be used when dial 100 is rotated to each of first and second sense-dry zones 105 and 110, with the cooldown time being substantially greater with first sense-dry zone 105. After the articles are dried to the selected dryness level, as sensed by moisture sensor 230, lower temperature air, for example, air from inside the room, is introduced into drum 14 to quickly cool the articles, while drum 14 is still tumbling. This reduces or prevents wrinkles or creases from forming once the clothes are dry. The procedure for programming CPU 210 with the position of dial 100 may be any conventional method known in the art or the procedure described in commonly assigned U.S. Patent Application entitled, "Strategy for Dryness Detection in a Clothes Dryer", filed on even date herewith and incorporated herein by reference.

If dial 100 has been rotated into first sense-dry zone 105, when the articles reach the selected dryness level, CPU 210 causes cool air to be introduced into drum 14 to reduce the temperature therein. CPU 210 then reads, or calculates if an algorithm is utilized, a cooldown time from drying schedule 215. Just as for expected drying time, the cooldown time may be in the form of a number or an algorithm through which a number may be calculated indicating the amount of time the cooldown sequence is to continue. CPU 210 also causes display driving circuit 225 to direct display 75 to indicate the number of minutes remaining in the cooldown sequence. Timer 220 is used to decrement display 75. The cooldown sequence then continues for the time indicated by the cooldown time, as read from drying schedule 215.

Once the cooldown time has expired and display 75 reads zero, CPU 210 updates the cooldown time stored in CPU 210 for the selected temperature. At the end of the cooldown sequence, temperature sensor 240 measures the temperature of exhaust air from drum 14. This temperature reading is compared to a reference value, preferably 100° F. (37.8° C.). If the temperature is less than the reference temperature, indicating to CPU 210 that the cooldown sequence has actually proceeded too long, CPU 210 subtracts one minute from the next cooldown sequence and stores this value in drying schedule 215. If, however, the temperature is greater than or equal to the reference temperature, CPU 210 adds one minute. In order to avoid extreme cooldown times, at both the short and long ends, CPU 210 is preferably prohibited from increasing the length of the cooldown time beyond twenty minutes and from decreasing the length below five minutes.

Figure 3A:
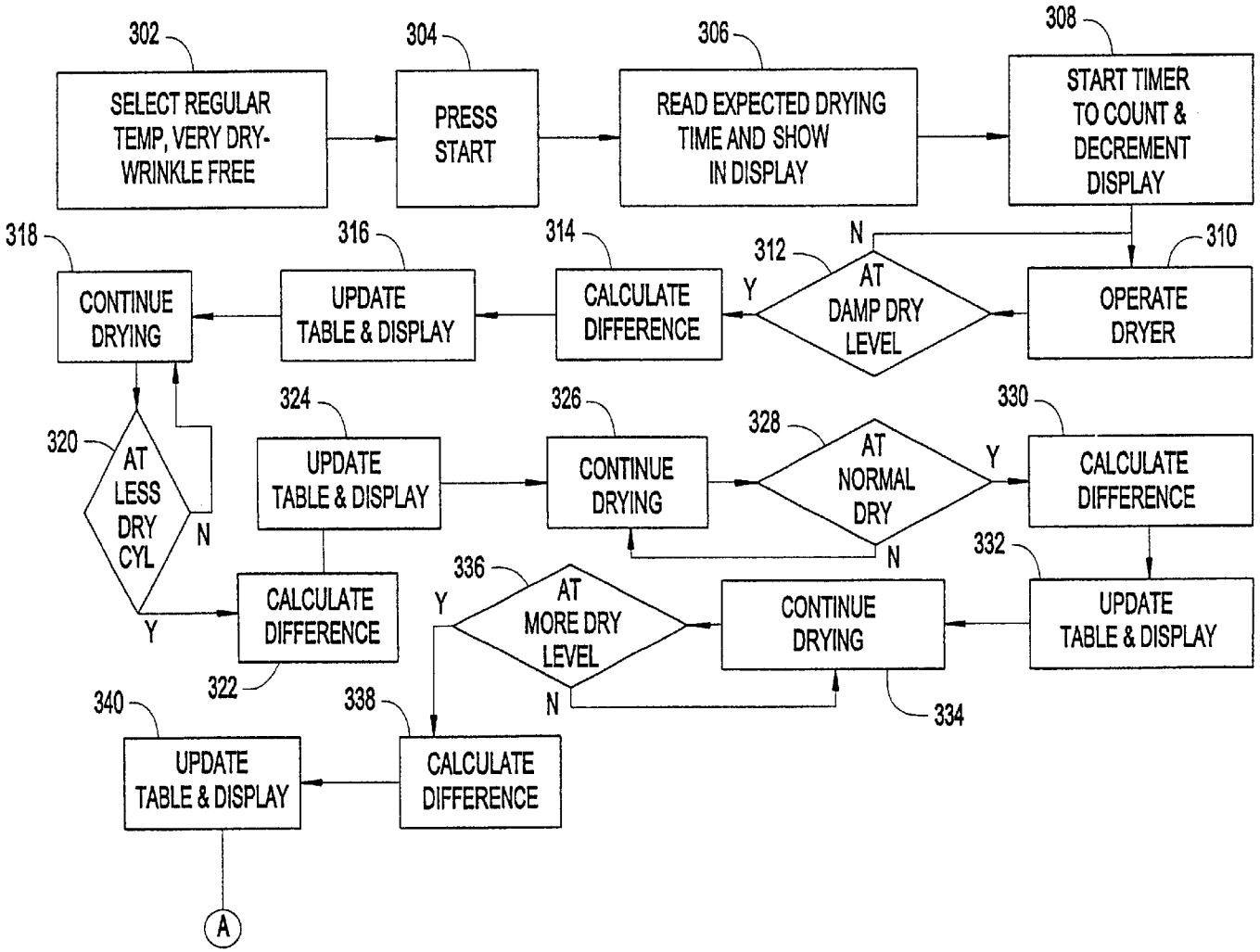
FIG. 3A is a diagrammatic representation of an initial portion of drying control sequence according to the invention.
Figure 3B:
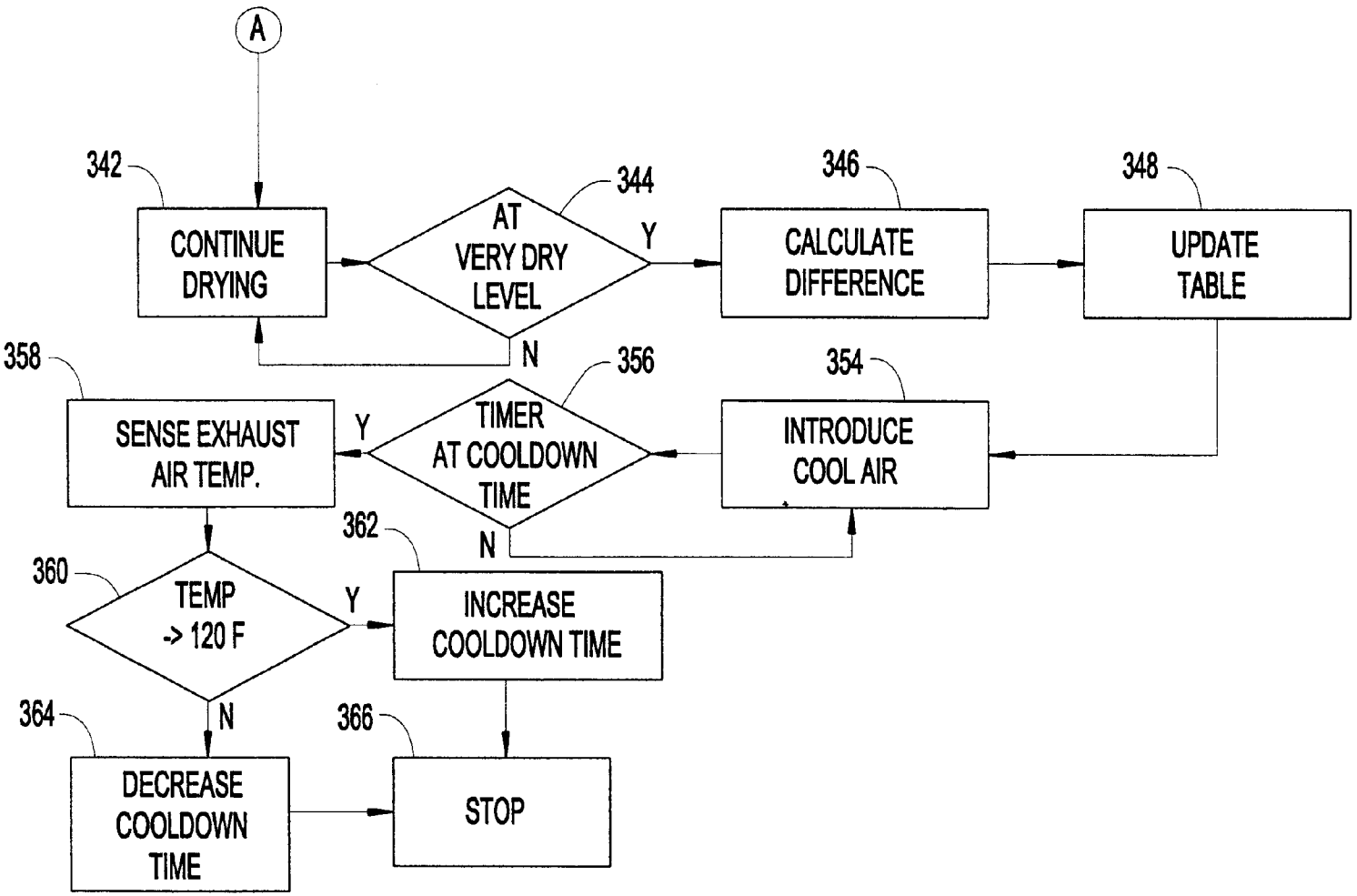
FIG. 3B is a diagrammatic representation of a latter portion of a drying control sequence according to the invention.

FIG. 3 represents a typical operation of clothes dryer 1. Specifically, the operation described in FIG. 3 details the operation of CPU 210 when clothes dryer 1 is operated with regular heat, the wrinkle-free operation and a VERY DRY dryness level after the first ten runs. Initially, a user selects the desired options (Step 302), i.e. heat level, cycle type and dryness level, and presses start (Step 304). CPU 210 then reads the expected drying time from drying schedule 215 and shows that number on display 75 (Step 306). Timer 220 is then started to begin timing the drying cycle and to decrement display 75 through display driving circuit 225 (Step 308). In Step 310, CPU 210 begins operation of clothes dryer 1 by rotating drum 14 and initiating the heater according to the selected heat level. Using moisture sensor 230, CPU 210 measures the dryness level of the articles and compares the level to a reference indicating DAMP DRY (Step 312). If the DAMP DRY level has not been reached, CPU 210 returns clothes dryer 1 to Step 310, wherein drum 14 and heater 260 are operated until the DAMP DRY level is reached. If, however, the DAMP DRY level has been reached, CPU 210 reads the duration from the start, as indicated by timer 220, and compares this value to the number read from the table of dryness schedules 215 corresponding to a regular heat and DAMP DRY moisture level (Step 314). The table and display 75 are updated in Step 316 by taking one-quarter of the difference between the two numbers and adding the result to each of the values representing the expected drying times for the LESS DRY, NORMAL DRY, MORE DRY and VERY DRY times. Additionally, display driving circuit 225 adjusts display 75 to read the new expected drying time as the estimated drying time remaining. As a result, display 75 initially displays the expected drying time read from drying schedule 215 and counts down until being updated, where it begins to count down again.

After updating the table and display (Step 316), CPU 210 continues operation of clothes dryer 1 until the LESS DRY threshold is reached (Step 320). Again, the difference between the duration since the drying operation was begun and the expected drying time corresponding to a regular heat and LESS DRY moisture level is calculated (Step 322) and the table and display 75 are updated just as in Step 316, i.e. one-quarter of the calculated difference is added to the expected drying times for regular heat and display 75 is changed to reflect the new expected drying time (Step 324). Drying the clothes continues (Step 326) until the NORMAL DRY threshold is reached (Step 328), where the difference between the expected drying time and the actual duration is again calculated (Step 330) and the table and display 75 are updated (Step 332), just as for the previous dryness levels. The same general procedure follows for the MORE DRY dryness level, i.e., continue drying (Step 334), when MORE DRY threshold is reached (Step 336), calculate the difference in times (Step 338), and update the table and display 75 (Step 340). Again, drying continues (Step 342) until the VERY DRY threshold is reached (Step 344), and the difference in times is calculated (Step 346). But because the articles have now reached the selected dryness level, only the table needs updating (Step 348).

As the wrinkle-free cycle was initially selected (Step 302), the cooldown sequence now begins with continued tumbling of drum 14 but no added heat. Again, each of the sense-dry cycles actually includes a cooldown cycle portion. In the wrinkle-free cycle, this portion is simply longer. In any event, the cooldown time is incorporated into the estimated drying time for the particular cycle. However, there would be a designated minimum cooldown time for each cycle. If this minimum amount of time is reached by timer 220 before Step 344 is realized, the timer 220 would be stopped until cooldown (Step 354) is reached. In any event, CPU 210 causes display driving circuit 225 to show the cooldown time on display 75 and restarts timer 220, as needed, to time the duration of the cooldown sequence. Cool air is introduced into drum 14 (Step 354) until the reading from timer 220 equals the cooldown time as indicated by drying schedule 215 (Step 356). The exhaust temperature is measured by temperature sensor 230 (Step 358) and compared to 100° F. (37.8° C.) (Step 360), although the final temperature level may vary in accordance with the invention. If the exhaust air temperature is greater than or equal to 100° F. (37.8° C.), CPU 210 increases the cooldown time for the next cycle by one minute (Step 362). If, however, the temperature of the exhaust air flow is less than 100° F. (37.8° C.), the cooldown time is decreased by one minute for the next cooldown sequence (Step 364). However, it must be remembered that, as discussed above, CPU 210 is required to maintain the cooldown time between five and twenty minutes, regardless of sensed temperature. Finally, the tumbling of drum 14 is terminated. At this point, it should be understood that the cool down time could be included in the displayed expected time remaining.

With this arrangement, dryer settings are not limited to those preset at the factory, but rather the settings are automatically customized based on varying environmental conditions, as well as customary user applications and preferences. By continually updating the display, the user is provided with a more accurate end-of-cycle time indication. Because the system is adaptive and learns, further "drying cycle" updates are incorporated into future cycles.

Although described with reference to preferred embodiments of the invention, it should readily understood that various changes and/or modifications could be made to the invention without departing from the spirit thereof. For example, it is possible to provide control panel 22 with a single heat selection to simplify the operations and drying schedule 215. Additionally, the number of dryness levels may be decreased to further simplify operation, or increased to give greater flexibility to the user. Furthermore, the invention could be modified to actually end the cool down portion of the cycle based solely upon sensing a predetermined temperature for the dryer, regardless of the actually displayed expected drying time. Finally, it is within the scope of this invention to utilize moisture sensor 230 to continually update or adjust moisture monitor 55 to show the current moisture level of the articles. In any event, the invention is only intended to be limited by the scope of the following claims.

We claim:

1. A method of controlling a clothes dryer comprising:

reading a desired dryness level selected by a user for articles of clothing to be dried in the clothes dryer;

establishing a drying cycle at a temperature for the clothes dryer in accordance with a drying schedule which is predetermined, depending upon the selected dryness level;

sensing an operational parameter of the drying cycle during the drying cycle; and adjusting the drying schedule, for subsequent drying cycles established for at least the selected dryness level, based upon the sensed operating parameter.

2. The method of claim 1, wherein said sensing step includes detecting a moisture level of articles of clothing contained within the clothes dryer.

3. The method of claim 2, further comprising: determining the drying schedule from an algorithm.

4. The method of claim 2, further comprising: reading the drying schedule from a table of expected drying times for at least one operation temperature and at least one dryness level.

5. The method of claim 4, further comprising: displaying a remaining drying time as read from the table.

6. The method of claim 4, further comprising:

determining a drying cycle time required to reach an intermediate dryness level as a sensed moisture level; and calculating a time difference between the drying cycle time required to reach the intermediate sensed moisture level and the expected drying time as read from the table.

7. The method of claim 6, wherein the intermediate dryness level is equal to the selected dryness level.

8. The method of claim 6, further comprising: adding a percentage of the time difference to the expected drying time for subsequent drying cycles.

9. The method of claim 6, further comprising: adjusting the values of expected drying times for each dryness level and operation temperature based upon the sensed moisture levels during the cycle.

10. The method of claim 9, wherein the values of expected drying times are adjusted by respectively adding or subtracting a percentage of the time difference.

11. The method of claim 6, further comprising: adjusting values of expected drying times for the selected dryness level based upon the sensed moisture levels at at least one time during the cycle.

12. The method of claim 1, wherein said drying cycle includes a cooldown step and the sensing of the operational parameter includes measuring a temperature of an exhaust air stream of said clothes dryer.

13. The method of claim 12, further comprising: comparing the temperature of the exhaust air stream to a reference temperature to determine the duration of said cooldown steps of future cycles.

14. The method of claim 13, wherein said adjusting step includes subtracting time from a cooldown segment of the drying schedule if the temperature of the air stream is less than the reference temperature or, in the alternative, adding time to the cooldown segment of the drying schedule if the temperature of the exhaust air stream is not less than the reference temperature.

15. A clothes dryer comprising:

an outer cabinet shell;

a drum rotatably mounted within said outer cabinet shell, said drum being adapted to receive articles of clothing to be heated and dried therein;

a system for sensing an operating parameter associated with the clothes dryer;

a control panel, attached to the outer cabinet shell, including at least one temperature selection member, a cycle selection element moveable through a first cycle zone during operation of said clothes dryer, and indicia, representative of said first cycle zone, extending adjacent at least a portion of said cycle selection element on said control panel;

a memory including a drying schedule; and means for adjusting said drying schedule during a drying operation of said clothes dryer based on the sensed operating parameter.

16. The clothes dryer according to claim 15, wherein said operating parameter is a moisture level of articles placed in the drum.

17. The clothes dryer according to claim 16, wherein said drying schedule is determined from an algorithm.

18. The clothes dryer according to claim 16, wherein said drying schedule includes a table of expected drying times for at least one dryness level.

19. The clothes dryer according to claim 18, further comprising: a display adapted to visually convey an expected drying time to a user of the clothes dryer.

20. The clothes dryer according to claim 16, wherein said cycle selection element is used to select a desired dryness level for the articles from among different dryness levels shown by said indicia.

21. The clothes dryer according to claim 20, further comprising:

a timer adapted to measure a time for a drying cycle; and means for comparing a time required to reach said desired dryness level, as measured by said timer and said sensing system, to an expected drying time.

22. The clothes dryer according to claim 21, further comprising: a display adapted to visually convey said expected drying time to a user of the clothes dryer.

23. The clothes dryer according to claim 21, wherein said comparing means is adapted to compare said expected drying time to said cycle time during said drying cycle.

24. The clothes dryer according to claim 18, wherein said table of expected drying times includes expected drying times for different desired final dryness levels.

25. The clothes dryer according to claim 15, wherein said drying operation includes a cooldown operation and said operating parameter is a temperature of an exhaust air stream of said clothes dryer.

26. The clothes dryer according to claim 25, further comprising:

means for comparing the temperature of the exhaust air stream to a reference temperature, and for subtracting time from said drying schedule if the temperature of the exhaust air stream is less than the reference temperature or, in the alternative, adding time to the drying schedule if the temperature of the exhaust air stream is not less than the reference temperature.

* * * * *